US011261625B2

(12) United States Patent
Nelsen et al.

(10) Patent No.: US 11,261,625 B2
(45) Date of Patent: Mar. 1, 2022

(54) DUAL ACTUATED LATCH MECHANISM FOR A VEHICLE

(71) Applicants: GM Global Technology Operations LLC, Detroit, MI (US); PyeongHwa Automotive Co., Ltd, Auburn Hills, MI (US)

(72) Inventors: James N. Nelsen, Howell, MI (US); Sung Han Kim, Daegu (KR)

(73) Assignees: GM GLOBAL TECHNOLOGY OPERATIONS LLC, Detroit (ML); PyeongHwa Automotive Co., LTD, Auburn Hills, MI (US)

( * ) Notice: Subject to any disclaimer, the term of this patent is extended or adjusted under 35 U.S.C. 154(b) by 351 days.

(21) Appl. No.: 16/458,812

(22) Filed: Jul. 1, 2019

(65) Prior Publication Data

US 2021/0002929 A1 Jan. 7, 2021

(51) Int. Cl.
*E05B 83/24* (2014.01)
*E05B 85/24* (2014.01)

(52) U.S. Cl.
CPC ..... *E05B 83/24* (2013.01); *E05B 85/24* (2013.01); *E05Y 2900/536* (2013.01)

(58) Field of Classification Search
CPC ..... E05B 83/24; E05B 85/24; E05B 83/16; E05B 83/243; E05Y 2900/536
USPC ..... 292/216, DIG. 14
See application file for complete search history.

(56) References Cited

U.S. PATENT DOCUMENTS 2,877,038 A 3/1959 Kramer
2,924,473 A * 2/1960 Krause ..... E05B 83/16 292/11
3,397,906 A * 8/1968 Beckman ..... E05B 83/16 292/29
4,875,724 A 10/1989 Gruber
(Continued)

FOREIGN PATENT DOCUMENTS

CN 109424279 A 3/2019
KR 20160180442 * 12/2016

OTHER PUBLICATIONS

U.S. Appl. No. 15/693,809, First Named Inventor: John Perring, "Latch Mechanism for a Vehicle," filed Sep. 1, 2017.
(Continued)

*Primary Examiner* — Christine M Mills
*Assistant Examiner* — Yahya Sidky
(74) *Attorney, Agent, or Firm* — Vivacqua Crane PLLC

(57) ABSTRACT

A vehicle hood latching mechanism is disclosed. The latching mechanism includes a housing securable to the vehicle body, a latch member pivotally connected to the first side of the housing, the latch member includes an external surface defining an abutment surface, a fork bolt adjustably connected to the second side of the housing and movable between a fully latched position, and an actuator assembly pivotally connected to the second side of the housing. The actuator assembly includes a first lever configured to selectively abut against the engagement surface of the fork bolt and a second lever configured to selectively engage the abutment surface of the latch member. The first lever is pivotally connected proximal to a first end of the mounting plate and the second lever is pivotally connected proximal to a second end of the mounting plate.

16 Claims, 7 Drawing Sheets

(56) References Cited

U.S. PATENT DOCUMENTS

| | | | | |
|---|---|---|---|---|
| 5,738,393 | A * | 4/1998 | Chao | E05B 83/24 292/216 |
| 6,386,599 | B1 | 5/2002 | Chevalier | |
| 2012/0161456 | A1* | 6/2012 | Riedmayr | E05B 83/24 292/226 |
| 2020/0141161 | A1 | 5/2020 | Nelsen et al. | |

OTHER PUBLICATIONS

U.S. Appl. No. 15/871,568, First Named Inventor: James N. Nelsen, "Latch Mechanism Fora Vehicle," filed Jan. 15, 2018.
U.S. Appl. No. 15/914,573, First Named Inventor: James N. Nelsen, "Dual-Pull Latch Assemblies for Compartment Closure Assemblies of Motor Vehicles," filed Mar. 7, 2018.
U.S. Appl. No. 16/105,079, First Named Inventor: James N. Nelsen, "Latch Mechanism," filed Aug. 20, 2018.

* cited by examiner

DUAL ACTUATED LATCH MECHANISM FOR A VEHICLE

INTRODUCTION

The disclosure relates to a hood latch mechanism for a motor vehicle, more particularly to a dual actuated hood latch mechanism having a remotely operated primary latching member and a secondary latching member.

In motor vehicles, a hood or bonnet is a moveable, typically hinged, panel that selectively covers and permits access to a compartment defined by the vehicle body. Vehicle hood latch systems typically include a striker on the hood, a primary latching member on the vehicle body engageable with the striker to hold the hood in the closed position, and a secondary latching member on the vehicle body in the path taken by the striker from the latched condition. The secondary latching member acts as a redundant safety device to prevent the hood from opening in the event that the primary latching member might not be properly latched or disengage during service.

For vehicle hood latches that use dual pull latches, both the primary latching member and the secondary latching member are typically cable-actuated from within the vehicle. The motorist is not required to leave the vehicle and insert his hand into a restricted space at the front edge of the hood in order to disengage the secondary latching member from the striker.

Thus, while dual pull latches achieve their intended purpose, there is a need for continuous improvement of the dual pull latch mechanism that achieves less latching and unlatching efforts as compared to current dual pull latches.

SUMMARY

According to several aspects, a vehicle having a hood latching mechanism is disclosed. The vehicle includes a vehicle body defining a compartment; a hood panel adjustably mounted to the vehicle body and configured to selectively cover and uncover the compartment, the hood panel includes a striker; and a latching mechanism configured to selectively engage and release the striker. The latching mechanism includes a housing secured to the vehicle body, wherein the housing includes a first side, an opposing second side; a latch member pivotally connected to the first side of the housing, the latch member includes an external side surface defining an abutment surface; a fork bolt pivotally connected to the second side of the housing, the fork bolt includes an engagement surface; and an actuator assembly pivotally connected to the second side of the housing. The actuator assembly includes a first lever configured to selectively abut against the engagement surface of the fork bolt and a second lever configured to selectively engage the abutment surface of the latch member.

In an additional aspect of the present disclosure, the actuator assembly includes an elongated mounting plate pivotally connected to the housing. The elongated mounting plate includes a first end and a second end opposite the first end. The first lever is pivotally connected proximal to the first end of the mounting plate and the second lever is pivotally connected proximal to the second end of the mounting plate.

In another aspect of the present disclosure, the elongated mounting plate and first lever are co-axially pivotally connected to the housing In another aspect of the present disclosure, the first lever and the second lever are pivotally connected to the mounting plate between the mounting plate and the housing In another aspect of the present disclosure, the elongated mounting plate includes a side surface defining a stop tab configured to cooperate with an abutment surface defined on the housing to limit the pivotal rotation of the mounting plate with respect to the housing.

In another aspect of the present disclosure, the second lever includes a first arm and a second arm defining a substantially C-shaped profile. The first arm includes a distal end configured to ride against the external cam surface of the fork bolt.

In another aspect of the present disclosure, the second arm includes a distal end having a projection configured to engage the abutment surface defined on the latch member.

In another aspect of the present disclosure, the latching mechanism includes a biasing member having a first end attached to the housing and a second end attached to the second arm of the second housing such that the biasing member rotatably biases the mounting plate in a first direction.

In another aspect of the present disclosure, the second lever is adapted to cooperate with the mounting plate such that the projection on the second arm of the second lever selectively moves in translational direction clearing the abutment surface of the latch member.

In another aspect of the present disclosure, the biasing member is a coiled spring under tension.

According to several aspects, a hood latching mechanism for releasably engaging a striker of a hood panel to a vehicle body is disclosed. The latching mechanism includes a housing securable to the vehicle body, the housing includes a first side, an opposing second side, and at least one housing cam surface; a latch member pivotally connected to the first side of the housing, the latch member includes an external surface defining an abutment surface; a fork bolt adjustably connected to the second side of the housing and movable between a fully latched position, wherein the fork bolt secures the striker to fasten the hood panel to the vehicle body, and a first actuated position, wherein the striker is released from the fork bolt, and wherein the fork bolt includes an external cam surface and an engagement surface; and an actuator assembly pivotally connected to the second side of the housing, the actuator assembly includes a first lever configured to selectively abut against the engagement surface of the fork bolt and a second lever configured to selectively engage the external cam surface of the fork bolt.

In an additional aspect of the present disclosure, the actuator assembly includes a pivotal elongated mounting plate having a first end, an opposite second end, and a side surface. The first lever and the second lever are pivotally connected to the mounting plate between the mounting plate and the housing.

In another aspect of the present disclosure, the first lever is pivotally connected on the mounting plate proximal to the first end and the second lever is pivotally connected on the mounting plate proximal to the second end.

In another aspect of the present disclosure, the first lever includes a first distal end configured to selectively abut against the engagement surface of the fork bolt to retain the fork bolt in the latched position.

In another aspect of the present disclosure, the second lever includes a first arm and a second arm cooperating with the first arm defining a substantially C-shaped profile.

In another aspect of the present disclosure, the first arm includes a distal end configured to ride against the external cam surface of the fork bolt.

In another aspect of the present disclosure, the second arm includes a distal end having a projection configured to engage the abutment surface defined on the latch member.

In another aspect of the present disclosure, the latching mechanism includes a spring having a first end attached to the housing and a second end attached to the second arm of the second housing such that the spring rotatably biases the mounting plate in a first direction.

According to several aspects, a vehicle having a hood latching mechanism is disclosed. The latching mechanism includes a housing having a first side and an opposing second side defining an abutment surface; a latch member pivotally connected to the first side of the housing, the latch member includes an external surface defining an abutment surface; a fork bolt rotatably connected to the second side of the housing, wherein the fork bolt includes an external cam surface and an engagement surface; and a mounting plate rotatably connected to the second side of the housing, the mounting plate includes a rotatable first lever having a distal configured to selectively engage the engagement surface of the fork bolt, and a rotatable second lever having a first arm configured to selectively engage the external cam surface of the fork bolt and a second arm having a projection configured to selectively engage the abutment surface of the latch member.

In an additional aspect of the present disclosure, the mounting plate and the first lever are co-axially rotatable.

The above features and advantages, and other features and advantages of the present disclosure, will be readily apparent from the following detailed description of the embodiment (s) and best mode(s) for carrying out the described disclosure when taken in connection with the accompanying drawings and appended claims.

DETAILED DESCRIPTION

The following description is merely exemplary in nature and is not intended to limit the present disclosure, application, or uses. The illustrated embodiments are disclosed with reference to the drawings, wherein like numerals indicate corresponding parts throughout the several drawings. The figures are not necessarily to scale and some features may be exaggerated or minimized to show details of particular features. The specific structural and functional details disclosed are not intended to be interpreted as limiting, but as a representative basis for teaching one skilled in the art as to how to practice the disclosed concepts.

Figure 1:
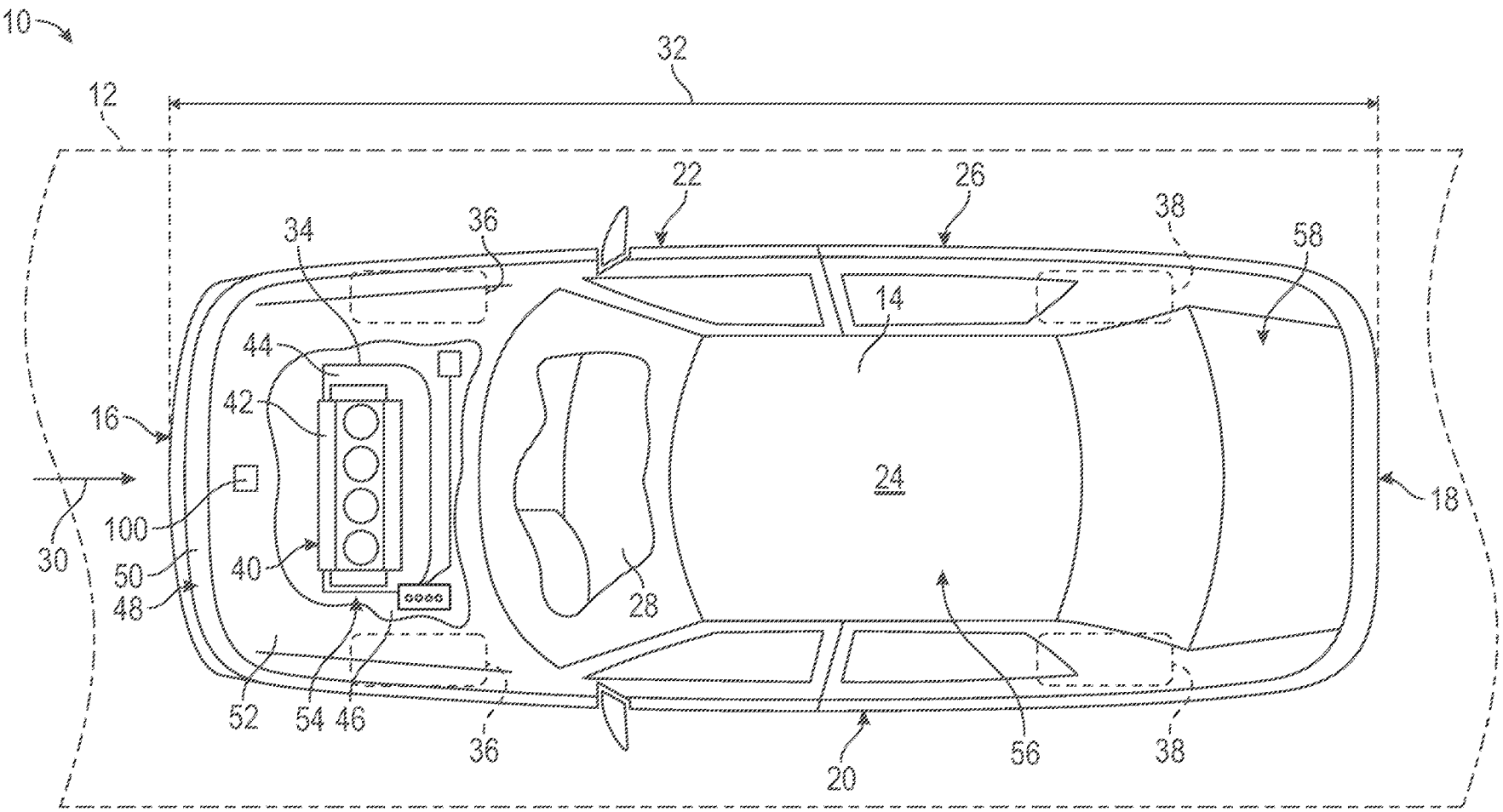
FIG. 1 is a schematic top view of a vehicle showing a partially sectioned hood panel and an under-hood compartment covered thereby, according to the disclosure.

Referring to the drawings, wherein like reference numbers correspond to like or similar components throughout the several Figures, an example vehicle 10 is shown schematically in FIG. 1. The vehicle 10 may include, but not be limited to, a commercial vehicle, industrial vehicle, passenger vehicle, aircraft, watercraft, train or any mobile platform. It is also contemplated that the vehicle 10 may be any mobile platform, such as an airplane, all-terrain vehicle (ATV), boat, personal movement apparatus, robot and the like to accomplish the purposes of this disclosure. For purposes of convenience and clarity, directional terms such as top, bottom, left, right, up, over, above, below, beneath, rear, and front, may be used with respect to the drawings. These and similar directional terms are not to be construed to limit the scope of the disclosure.

The vehicle 10 in FIG. 1 is positioned relative to a road surface 12. The vehicle 10 includes a first end or front end 16, an opposing second end or rear end 18, a first lateral portion or left side 20 generally extending between the first and second ends 16, 18, and an opposing second lateral portion or right side 22. The vehicle body 14 further includes a top body portion 24, which may include at least a vehicle roof portion, and an opposing lower body portion or underbody 26. A passenger compartment 28 is defined in the vehicle body 14. As understood by those skilled in the art, the first or front end 16 may face oncoming ambient airflow 30 when the vehicle 10 is in motion relative to the road surface 12. Each of the left side, right side, top, and underbody body sections, 20, 22, 24, and 26, respectively, spans a distance 32 between the front and rear ends 16, 18 of the body 14.

The vehicle 10 includes one or more wheels 36, 38 arranged between the first and second vehicle body ends 16, 18, proximate the left and right sides 20, 22. The one or more wheels includes a first set of wheels 36 disposed proximate the first or front end 16 of the vehicle 10 and a second set of one or more wheels 38 disposed proximate the second or rear end 18 of the vehicle 10. As shown in FIG. 1, the first set of one or more wheels 36 includes a pair of front wheels that are rotatably connected to the vehicle 10 and rotate about an axis while the second set of one or more wheels 38 includes a pair of rear wheels that are rotatably connected to the vehicle 10 and rotate about an axis.

The vehicle body 14 defines a compartment 46 for housing a powertrain 40. The powertrain 40 that may include an internal combustion engine 42 for generating engine torque and a transmission 44 operatively connecting the engine 42 to at least some of the road wheels 36, 38 for transmitting engine torque thereto. For an electric or hybrid vehicle, the powertrain 40 may include one or more motor-generators, none of which are shown, but the existence of which can be appreciated by those skilled in the art. However, it is understood that the compartment 46 may be configured as a storage compartment or other vehicle space if the powertrain 40 of the vehicle 10 is positioned in a central or rear portion of the vehicle 10.

As shown, the vehicle body 14 also includes a vehicle fascia 48 arranged at the front end 16. The fascia 48 defines at least one opening 50 receiving at least some of the oncoming ambient airflow 30, which may be used for cooling the powertrain 40. Generally, the at least one opening 50 that is provided in the front end 16 of the vehicle 10, such as the grille openings 50, as well as various protruding features on the surface of the vehicle body 14, tend to impact the vehicle's 10 aerodynamic signature. Although one grille opening 50 is depicted and described, nothing precludes the vehicle 10 from having a greater number of grille openings for admitting the ambient airflow 30 into the compartment 46 from the ambient atmosphere.

The vehicle 10 also includes a hood panel or bonnet 52 adjustably mounted to the vehicle body 14 and movable between at least one open position where the hood panel 52 is unfastened from the vehicle body 14 to provide access to the compartment 46 and a closed position wherein the hood panel 52 extends at least partially above and across to cover the compartment 46 to restrict access to the compartment 46. The hood panel 52 may be pivotally mounted to one or more load-bearing body frame members of the body 14 of the vehicle 10 to provide access to and securely close the top portion of the compartment 46. The vehicle 10 may also include a vehicle roof, generally represented by numeral 56, and a trunk lid 58. Corresponding to the specifically shown front-engine configuration of the vehicle 10, the hood panel 52 is depicted as arranged generally proximate the front end 16, while the trunk lid 58 is arranged generally proximate the rear end 18 of the vehicle body 14 of the vehicle 10.

The vehicle 10 is equipped with a latch and lock system that employs a concealed hood latching mechanism 100 movable between a latched position to secure the hood panel 52 in a closed position relative to the vehicle body 14, as shown in FIG. 1 and at least one unlatched or actuated position. It is contemplated that the latching mechanism 100 is mounted to the front or forward portion of the vehicle 10 with a hood panel 52 that opens from the forward portion of the vehicle 10. The latching mechanism 100 cooperates with the hood panel 52 to secure the hood panel 52 proximate to the compartment 46 in the vehicle body 14. Further, it is contemplated that the latching mechanism 100 of the present disclosure may be configured for use without an external handle or member cooperating with the latching mechanism 100 to releasably secure the hood panel 52 to the latching mechanism 100 and thereby, the hood panel 52 to the vehicle 10.

Referring to the FIGS. 2A-2B through 7A-7B, while the latching mechanism 100 is illustrated in one non-limiting configuration, it is understood that the latching mechanism 100 may be installed in a variety of positions and arrangements depending upon the configuration of the vehicle 10. For example, the front or forward view may be reversed with the rear or rearward views such that the latching mechanism 100 may be mounted to either the front or the rear of a tie bar structure. Further, the latching mechanism 100 may be configured for use in right hand drive and left-hand drive vehicle configurations in order to dictate the cable going to the driver's side of the vehicle. Additionally, the vehicle 10 may feature more than one latching mechanism 100 located at a distance from a centerline of the vehicle 10 on either side of a tie bar member, or may be oriented right to left rather than front to back. Alternatively, the latching mechanism 100 may be mounted to the hood panel 52 of the vehicle 10.

Figure 2A:
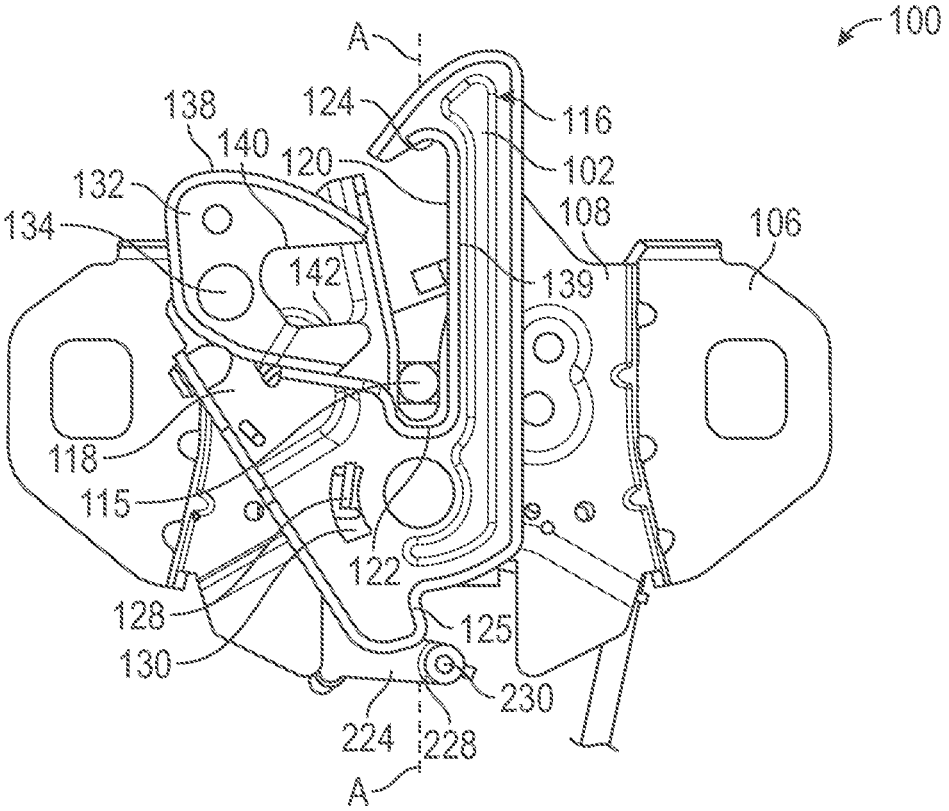
FIGS. 2A-2B are schematic front and rear views of a latching mechanism in a fully latched position.
Figure 2B:
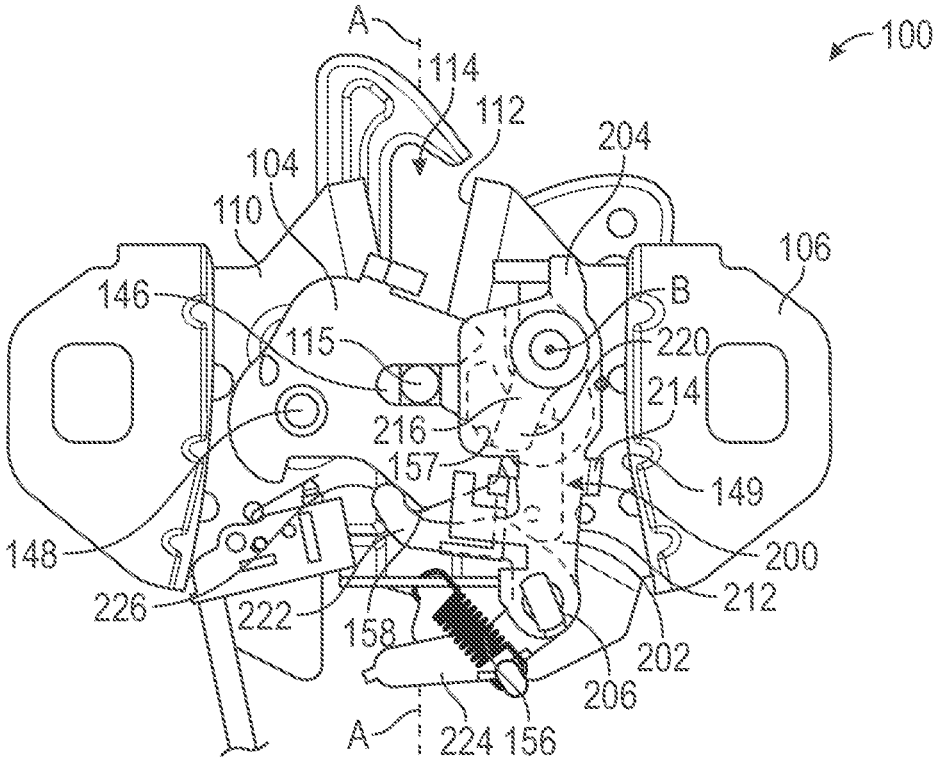

Referring to FIG. 2A-2B, the latching mechanism 100 is shown in a fully latched position. The latching mechanism 100 includes a latch member 102 and a fork bolt 104, both of which are pivotally connected to a housing 106 via a fastener, such as a rivet or the likes. The housing 106 is in turn mounted to a portion of the vehicle body 14. The housing 106 includes a first side 108 shown in FIG. 2A and an opposing second side 110 shown in FIG. 2B. The first side 108 of the housing 106 receives the latch member 102 pivotally connected thereto and the second side 110 receives the fork bolt 104 pivotally connected thereto. The housing 106 further includes a housing cam surface 112 extending between the first side 108 and second side 110 adjacent a central region of the housing 106 defining a striker channel 114 extending along an A-axis. The striker channel 114 is configured to receive and guide a striker 115 therethrough.

The latch member 102 includes a first lever arm 116, a second lever arm 118 extending from the first lever arm 116 at an acute angle, and a latch side surface 120 extending through the first lever arm 116 and the second lever arm 118. The latch side surface 120 defines a primary catch portion 122 between the intersection of the first lever arm 116 and the second lever arm 118, and a secondary catch portion 124 on the first lever arm 116 facing the primary catch portion 122. The primary catch portion 122 is defined adjacent the striker channel 114 in the central region of the housing 106. The secondary catch portion 124 is defined above an upper portion of the housing 106. The latch member 102 further includes an external side surface defining an abutment surface 125, also referred to as a ratchet tooth 125.

The latching mechanism 100 includes a first biasing member 126 such as an over-center spring 126 (best shown in FIG. 5A) or the like, operating bi-directionally and applying a force to selectively preload the latch member 102 to selectively rotate in opposing directions. The first biasing member 126 may also be that of torsional toggle spring, a pin acting on a bent leaf spring that compresses against the pin going over a hump in the middle, and/or other extension/compression springs that have a similar over-center characteristic. The first biasing member 126 may be configured such that, depending on the position of the latch member 102, the force of the first biasing member 126 may be applied in one direction, or another, opposite direction. For example, as shown in FIG. 2A the force of the first biasing member 126 is applied in a first direction, a counter-clockwise direction, to maintain the primary catch portion 122 in a latched position to facilitate closure of the under-hood compartment 54 via the hood panel 52. Also, for example, in FIG. 5A, the force of the first biasing member 126 is applied in a second direction, shown as a clockwise direction, to maintain the primary catch portion 122 in an unlatched position spaced apart from the path of travel of the striker 115.

Referring back to FIGS. 2A and 2B, the latching mechanism 100 may also include a limiter 128 configured to travel in a slot 130 defining a range of motion for the latch member 102. The limiter 128 is shown extending from the housing 106. The slot 130 may be formed in a portion of the latching mechanism 100 and may be formed in a variety of geometries and positions. In one non-limiting example, slot 130 may be arcuate in shape configured to define a predetermined angle of rotation for the latch member 102 relative to a pivot center. The slot 130 may be sized to allow the limiter 128 to travel therein and thereby, limit the range of motion of the limiter 128 within the geometry defined by the slot 130.

The latching mechanism 100 further includes a cancel lever 132 pivotally mounted to an end of the second lever arm 118 spaced apart from the primary catch portion 122. The cancel lever 132 includes a second biasing member 134, such as a spring, urging the cancel lever 132 to rotate in a first direction, shown as a clockwise direction in FIG. 2A, causing the cancel lever 132 to abut the second lever arm 118 thus limiting the rotation of the cancel lever 132. The cancel lever 132 (best shown in FIG. 6A) further includes an exterior cam surface 138 transitioning through an apex 139 to a first interior surface 140, which transitions to a second interior surface 142. The first interior surface 140 faces in a direction away from the exterior cam surface 138 and toward the second interior surface 142. The exterior cam surface 138 is configured such that a force applied along the A-axis onto the exterior cam surface 138 induces a moment M onto the second lever arm 118 causing the latch member 102 to rotate in a second direction, counter-clockwise as viewed in FIG. 2A.

Referring to FIG. 2B, the fork bolt 104 defines a fork bolt channel 146 configured to receive and secure the striker 115 in the latched position to fasten the hood panel 52 to the vehicle body 14. The fork bolt 104 is positioned on the housing 106 such that the fork bolt 104 and fork bolt channel 146 of the fork bolt 104 are disposed proximal to the striker channel 114. In one non-limiting embodiment, the fork bolt 104 is pivotally connected to the second side 110 of the housing 106 on the opposing surface from the latch member 102 and is movable between a locked position wherein the fork bolt channel 146 of the fork bolt 104 secures the striker 115 to fasten the hood panel 52 to the vehicle body 14 in the latched position and an unlocked position allowing the striker 115 to be released from the fork bolt channel 146. The fork bolt 104 includes an engagement surface 157 and an external cam surface 158 configured to cooperate with an actuator assembly 200 to selectively receive and release the striker 115 from the fork bolt channel 146. The release of the fork bolt 104 frees the hood panel 52 to separate from the vehicle body 14 at least a predetermined distance and thereby establish an opening between the vehicle body 14 and the hood panel 52.

The latching mechanism 100 includes a third biasing member (not shown), which may be a clock spring or the like, operatively connected to the fork bolt 104 to allow the fork bolt 104 to selectively rotate relative to the housing 106. The third biasing member may apply a preload force directed to bias the fork bolt 104 to rotate from a locked position to an unlocked position where the fork bolt 104 releases the striker 115 and permits the hood panel 52 to move away from the vehicle body 14 in response to a first actuation of a device 150. The fork bolt 104 along with the third biasing member may be operatively connected to the housing 106 via a suitable fastener, such as a rivet or the like.

The actuator assembly 200 includes an elongated mounting plate 202 having a first end 204, an opposite second end 206, and a side surface 212. The elongated mounting plate 202 is pivotally connected to the housing 106 about a rotational axis B proximal to the first end 204 of the elongated mounting plate 202. The side surface 212 defines a stop tab 214 configured to cooperate with an abutment surface 149 of the housing 106 to limit the pivotal rotation of the mounting plate 202 with respect to the housing 106.

The mounting plate 202 further includes a first lever 216, also referred to as a detent lever 216, configured to selectively engage the engagement surface 157 of the fork bolt 104, and a second lever 218 (best shown in FIG. 3B), also referred to as a pull lever 218 or double-pull lever 218, configured to selectively engage the external cam surface 158 (best shown in FIG. 3B) of the fork bolt 104. In the embodiment shown, both the first lever 216 and the second lever 218 are pivotally mounted on the mounting plate 202 and sandwiched between the mounting plate 202 and the housing 106. The actuator assembly 200 may be actuated by a cable, a lever with a catch, and/or a solenoid actuated by the operator of the vehicle 10.

The first lever 216 is pivotally connected, co-axial with the rotational axis B, proximal to the first end 204 of mounting plate 202. In the embodiment shown, the first lever 216 is sandwiched between the mounting plate 202 and the housing 106. The first lever 216 includes a first distal end 220 configured to selectively abut against the engagement surface 157 of the fork bolt to retain the fork bolt 104 in the latched position. The second lever 218 includes a first arm 222 and a second arm 224 defining a substantially C-shaped profile. The second lever 218 is pivotally connected proximal to the second end 206 of the mounting plate 202. The first arm 222 includes a distal end 226 configured to ride against the external cam surface 158 of the fork bolt 104. The second arm 224 includes a distal end 228 having a projection 230 configured to selectively engage the abutment surface 125 defined on the latch member 102.

A fourth biasing member 156 is provided to rotatably bias the actuator assembly 200 in a first direction, which is shown as a clockwise direction in FIG. 2B. The fourth biasing member 156 may be a coiled spring under tension or the likes configured to apply a force to bias the actuator assembly 200 to rotate in a first direction, which is shown as a clock-wise position in FIG. 2B. A first end 159 of the fourth biasing member 156 (best shown in FIG. 3B) is connected to the housing and a second end 161 of the fourth biasing member is shown connected to the second arm of the second lever 218.

In a mechanical system architecture, pulling on the hood latch release mechanism such as a release lever applies a tensile force to a hood latch release cable (not shown), such as a Bowden-type cable, connected to the actuator assembly 200. The release cable pulls on the actuator assembly 200 to actuate the latching mechanism 100 to unlatch the striker 115 by disengaging the first lever 216 from the engagement surface 157 of the fork bolt, thereby allowing the hood panel 52 to be moved to an open position. Other hood latch release mechanisms, including mechanical, electrical, and electro-mechanical configurations, are envisioned as being within the scope of this disclosure. For instance, the release cable may be representative of a cable, rod, or lever actuated by an electrical or pneumatic actuator in applications where the hood latching mechanism 100 is embodied as a power hood latch.

Figure 4A:
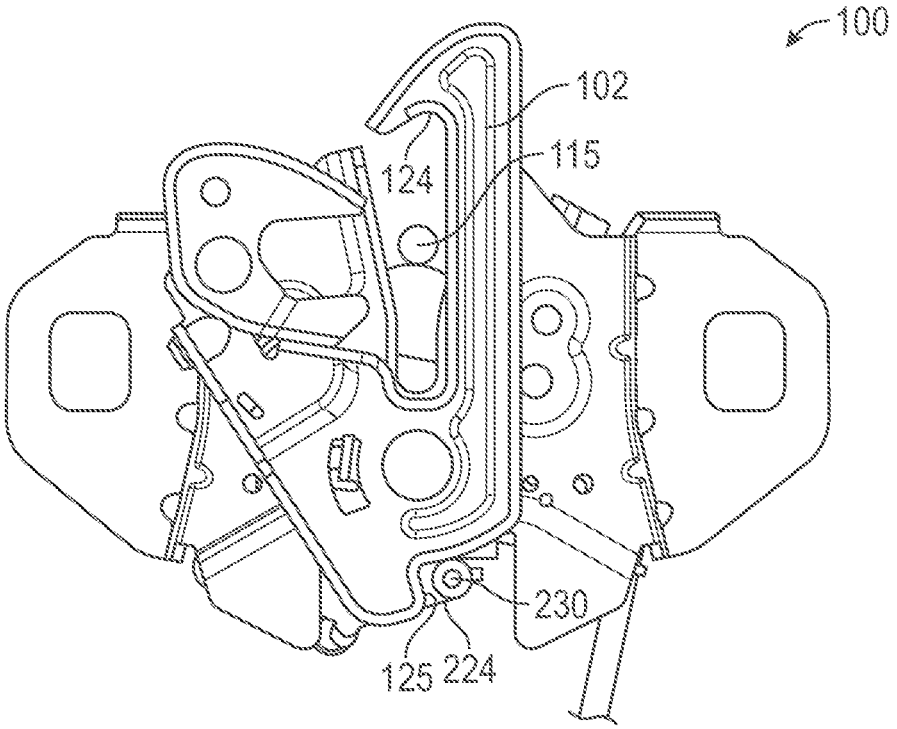
FIGS. 4A-4B are schematic front and rear views of the latching mechanism in the first actuated position.
Figure 4B:
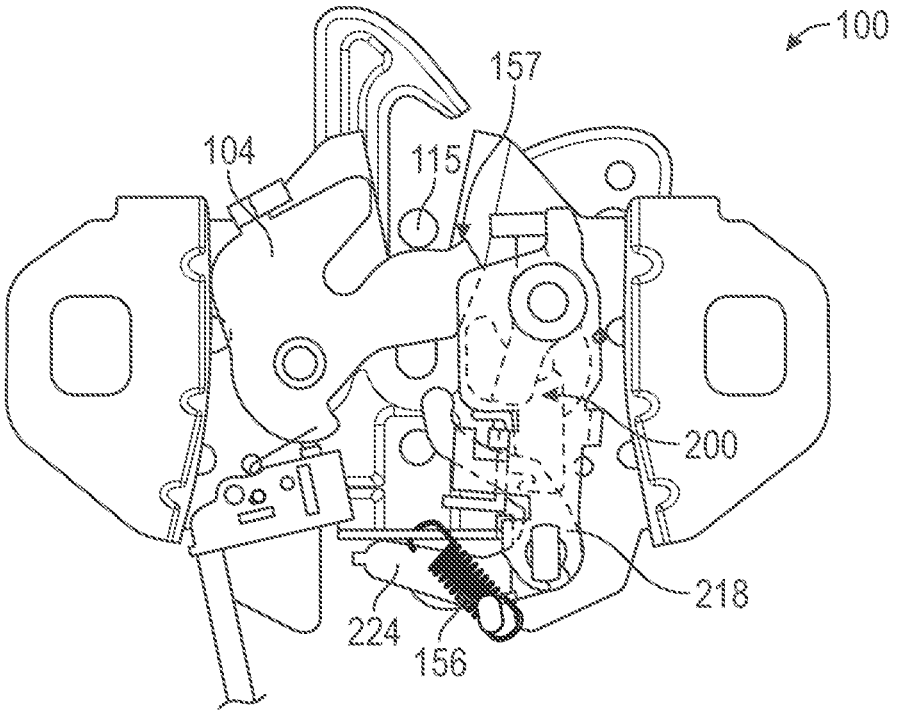
Figure 5A:
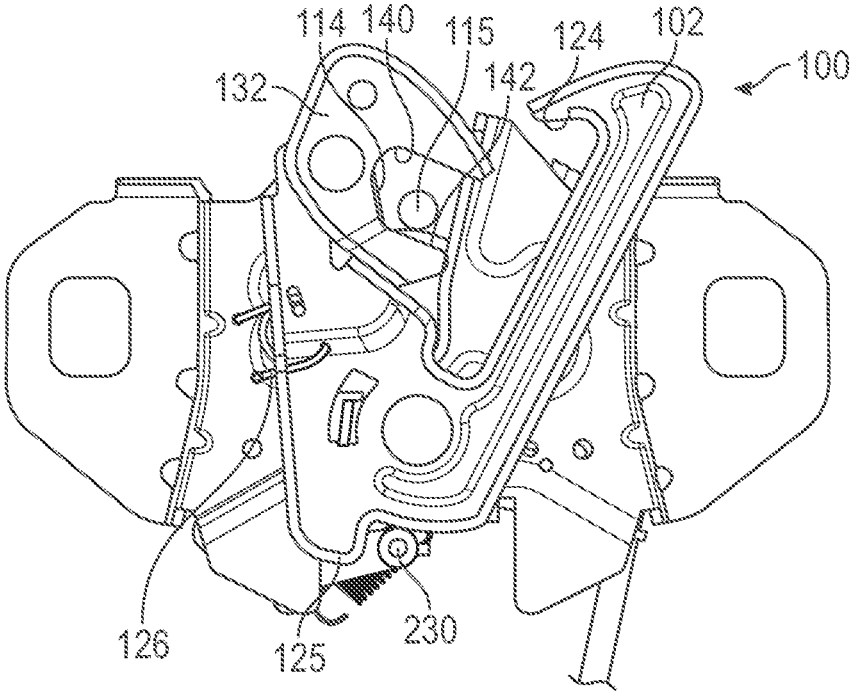
FIG. 5A-5B are schematic front and rear views of the latching mechanism in the second actuated position.
Figure 5B:
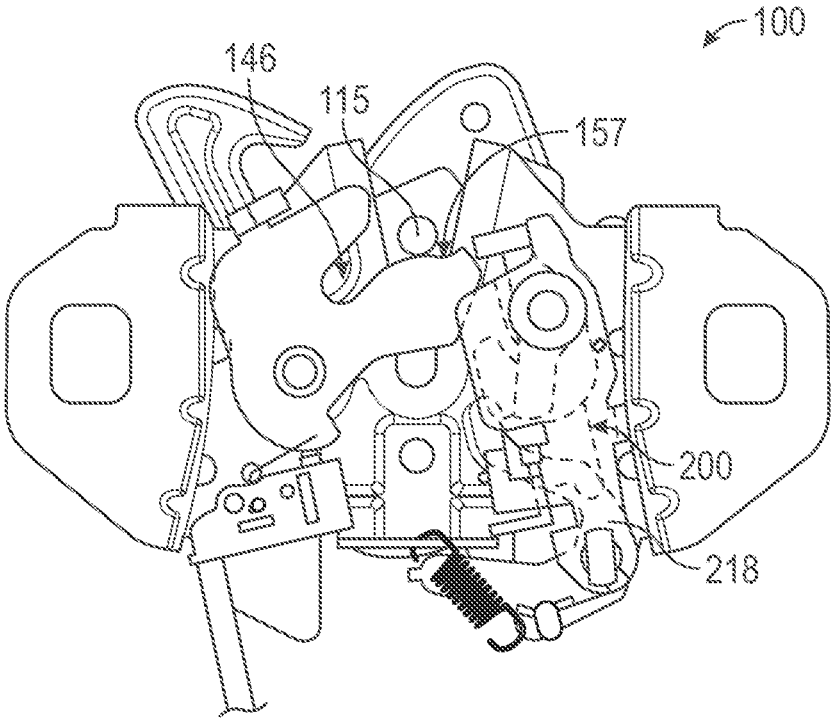
Figure 6A:
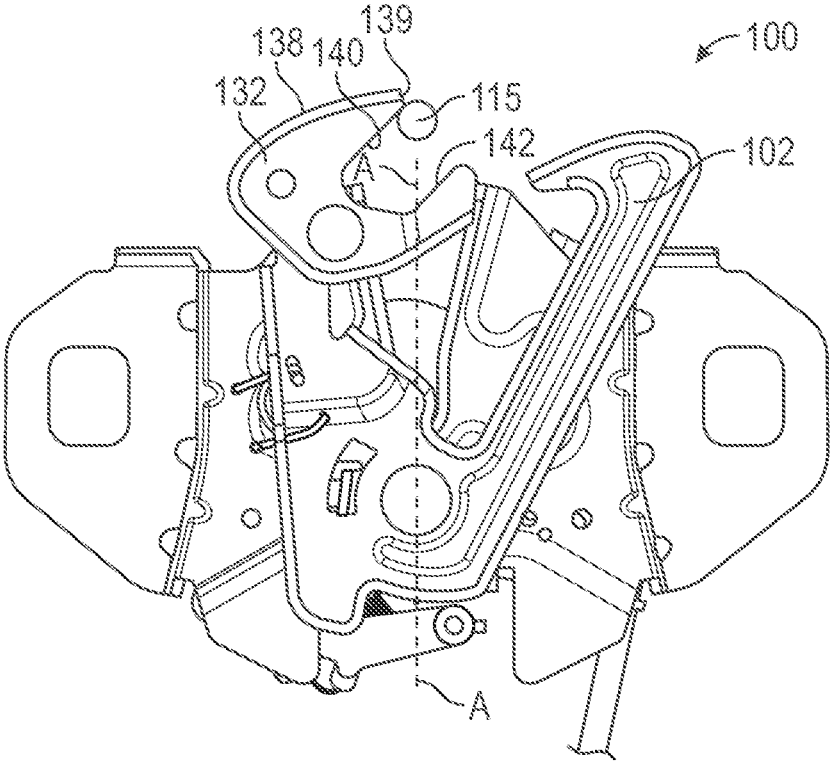
FIGS. 6A-6B are schematic front and rear views of the latching mechanism transitioning into a fully unlatched position from the second actuated position.
Figure 6B:
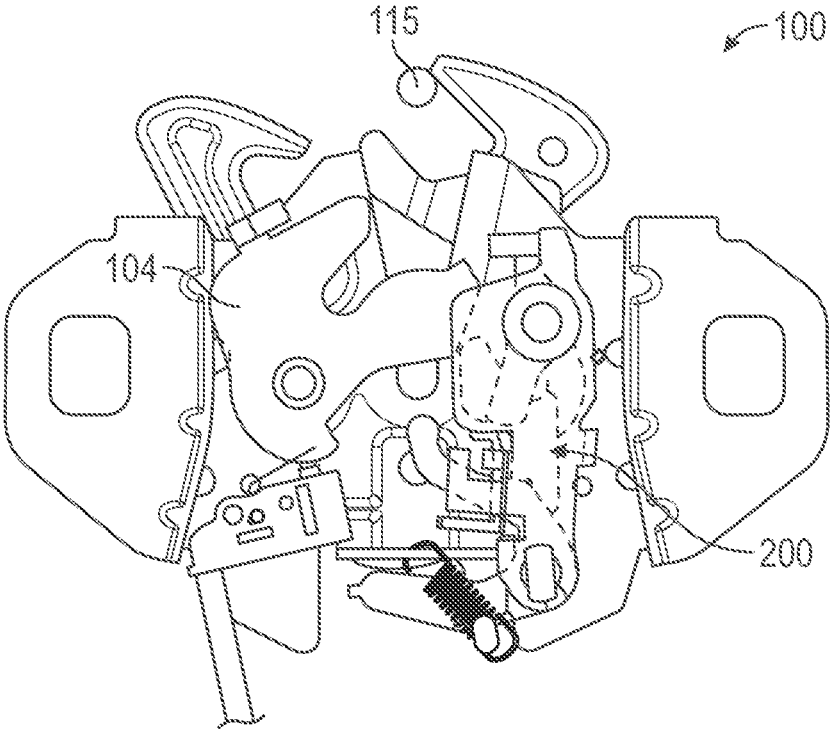

In a dual actuated system, the first actuation places the latching mechanism 100 in a first actuated position as shown in FIGS. 4A-4B. In the first actuated position, the striker 115 is released from the fork bolt 104 and cooperates with the latch member 102 to maintain the hood panel at least a predetermined distance from the vehicle body. A second pull of the release cable places the latching mechanism 100 in a second actuated position where the secondary catch portion 124 of the latch member 102 pivots away from the A-axis as shown in FIGS. 5A-5B. The striker 115 is held in position between the interior surfaces 140, 142 of the cancel lever 132. In the second actuated position, the hood may be manually lifted to overcome the biasing force of the second biasing member 134 such that the cancel lever 132 rotates out of the way as shown in FIGS. 6A-6B.

Referring back to FIGS. 2A-2B, in the fully latched position, the primary catch portion 122 of the latch member 102 is configured to cooperates with the fort bolt 104 to facilitate or maintain closure of the under-hood compartment 54 via a striker 115 cooperating with the hood panel 52 such that the panel 52 is being positioned adjacent or against the vehicle body 14. The actuator assembly 200 is shown disposed on one side of the housing 106 while the latch member 102 is disposed on an opposing side of the housing 106.

Figure 3A:
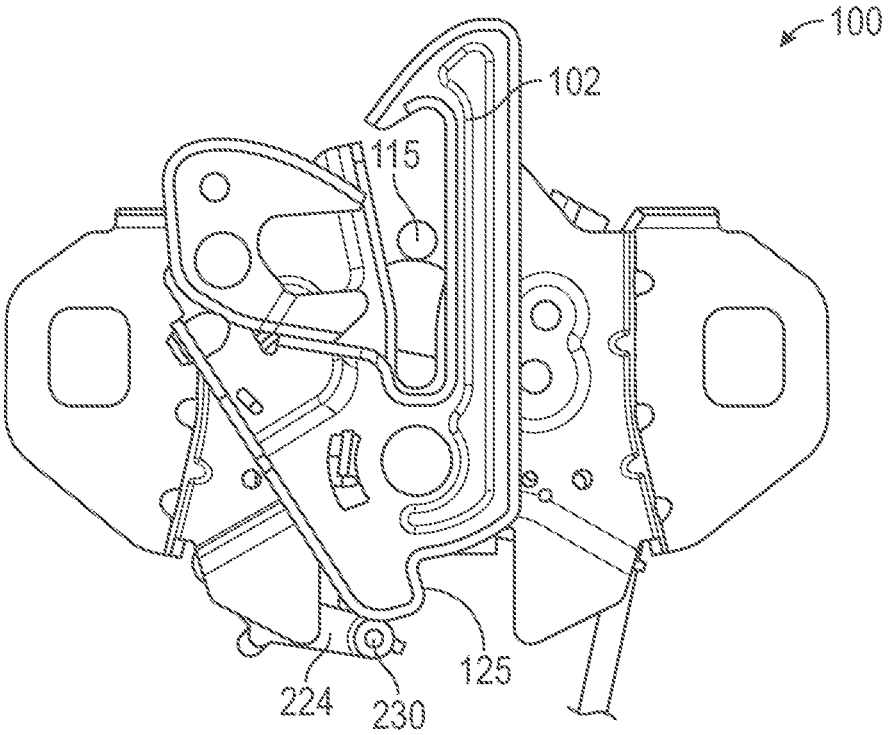
FIGS. 3A-3B are schematic front and rear views of the latching mechanism transitioning to a first actuated position from the fully latched position.
Figure 3B:
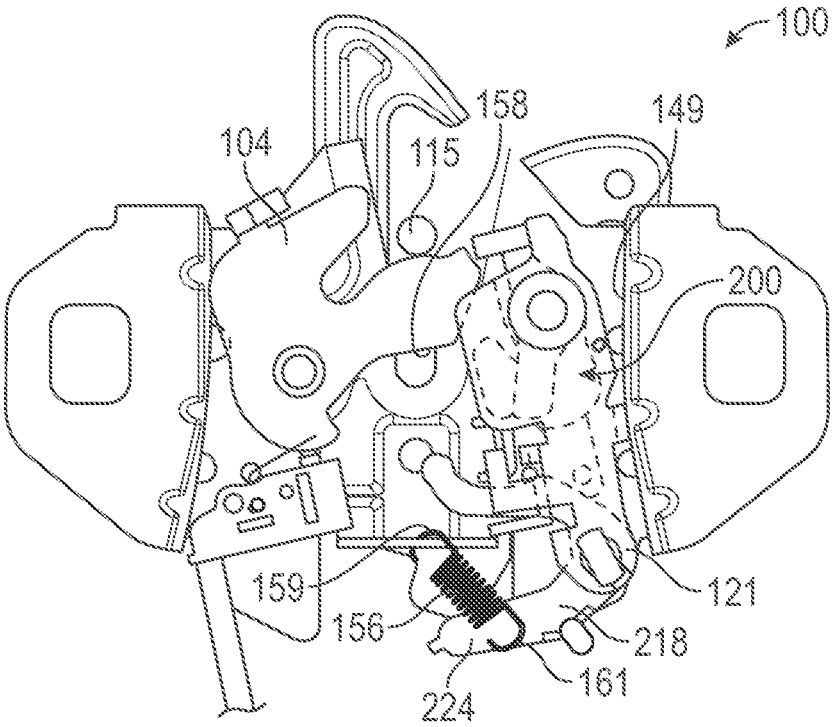

From the fully latch position shown in FIGS. 2A-2B, the actuator assembly 200 may be actuated by a pull cable or other manners to release the fork bolt 104 from engagement with the actuator assembly 200. The actuator assembly 200 selectively rotates between an engaged position as shown in FIG. 2B and a disengaged position as shown in FIG. 3B. In the disengaged position, the third biasing member applies a force to shift or selectively rotate the fork bolt 104 in a counterclockwise manner from the locked position to an unlocked position where the fork bolt 104 releases the striker 115 when the distal end of the first lever 216 of the actuator assembly 200 disengages from the engagement surface 157 of the fork bolt 104. Referring to FIGS. 3A and 3B, in response to movement of the actuator assembly 200, the second lever 218 rotates such that the projection 230 on the second arm 224 translates to clear the abutment surface 125 of the latch member 102 before returning to engage the abutment surface 125 of the latch member 102 when the fork bolt 104 is fully disengaged as shown in FIG. 4A.

Referring now to both FIGS. 4A-4B, the latching mechanism 100 is shown in a first actuated position, also known as the first unlatched position. The latch member 102 is configured such that the secondary catch portion 124 extends generally above a central region of the latching mechanism 100 to releasably engage and receive the striker 115 in the secondary catch portion 124 as the striker 115 moves to the full travel position of the second catch portion 124. The secondary catch portion 124 may also provide physical feedback to the actuator assembly 200 and related components to indicate completion of the second position movement. In response to positioning of the striker 115 in the secondary catch portion 124, the projection 230 of the second arm 224 of the second lever 218 of the actuator assembly 200 is repositioned adjacent the abutment surface 125.

Referring now to FIGS. 5A-5B, the latching mechanism 100 is shown in a second actuated position or second unlatched position. In the transition from the first unlatched position, as shown in FIGS. 4A-4B, to the second unlatched position, as shown in FIGS. 5A-5B, the second lever 218 is adjusted such that projection 230 engages the abutment surface 125 of the latch member 102 when the actuator assembly 200 is actuated, thereby translating or rotating the latch member 102 from the first unlatched position to the second unlatched position. In response to second actuation of the actuator assembly 200, the latch member 102 is selectively rotated or translated relative to the housing 106 such that the secondary catch portion 124 is translated away from a position adjacent the central region of the latching mechanism 100.

The latching mechanism 100 in the second actuated position, as shown in FIG. 5A-5B may be repositioned back into the fully latched position, as shown in FIGS. 2A-2B, without the need to first fully releasing the striker from the latching mechanism 100 from the second actuated position. This can be accomplished by pushing the hood of the vehicle into the closed position, causing the striker 115 to travel along the striker channel 114 to engage the second interior surface 142 of the cancel lever 132 and then into the fork bolt channel 146, thereby causing both the latch member 102 and fork bolt 104 to rotate back into the fully latch position as shown in FIGS. 2A-2B.

FIG. 6A-6B, the latching mechanism 100 is shown with the striker 115 transitioning into a fully unlatch position positioned apart from the latching mechanism 100, these enabling the full opening of the hood from the vehicle body. The cancel lever 132 rotates back to a position proximate the central region 102 of the latching mechanism 100 after the striker 115 is removed from the latching mechanism 100. As shown in FIG. 6A, the apex 139 extends sufficiently into the path of travel of the striker 115 along the A-axis when the latching mechanism 100 in the fully unlatched position such that the striker 115 will contact the exterior cam surface 138 upon the closing of the hood.

Figure 7A:
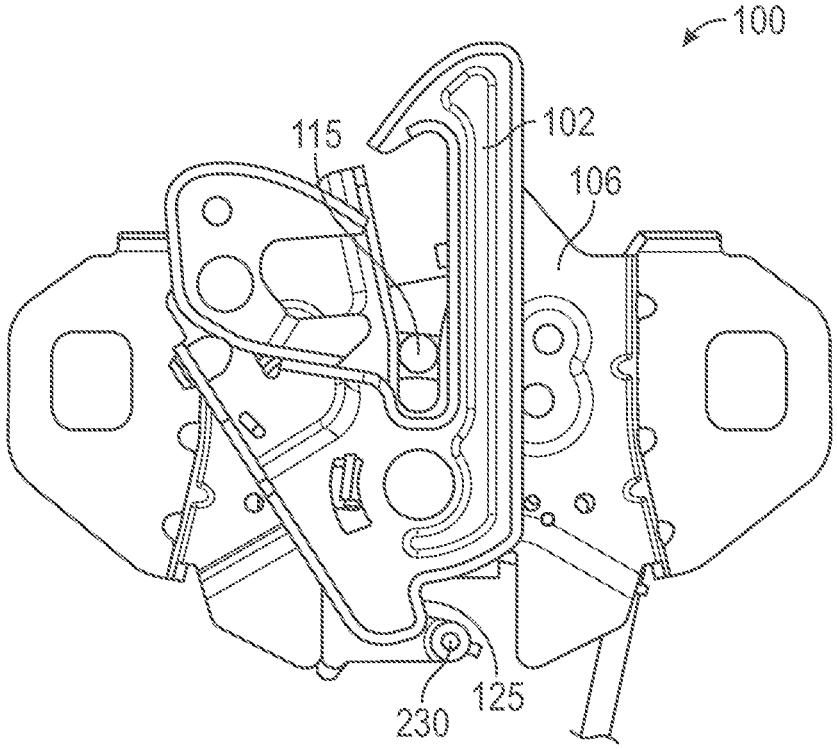
FIGS. 7A-7B are schematic front and rear views of the latching mechanism transitioning to the fully latched position from the fully unlatched position.
Figure 7B:
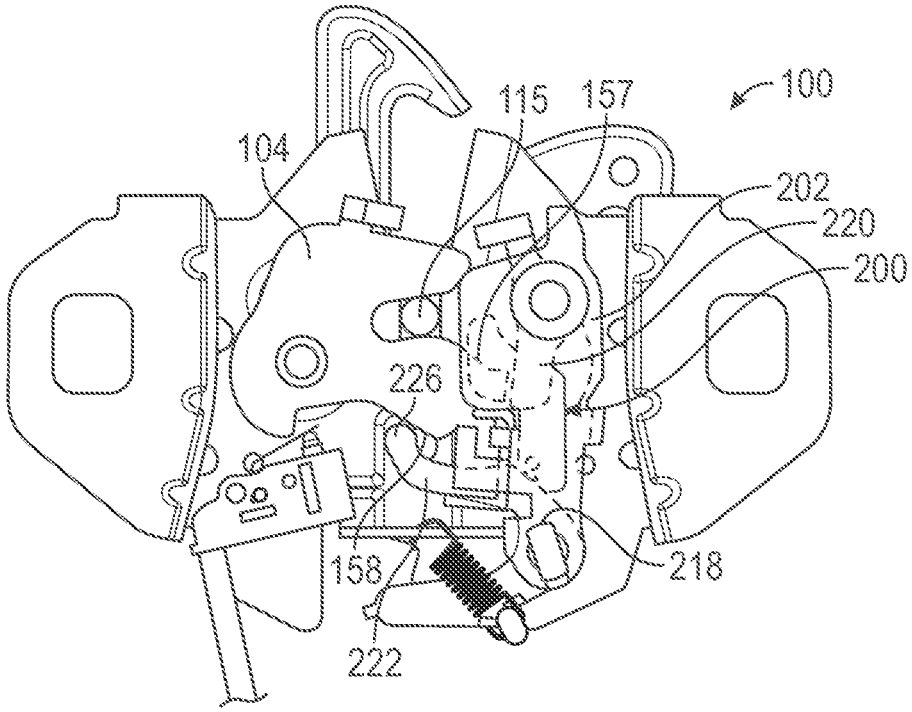

As shown in FIGS. 7A-7B, the latch member 102, the latching mechanism 100 is shown transitioning into back a latched position as the striker 115 is positioned in the latching mechanism 100 to re-latch the striker 115 in the fork bolt 104. The fork bolt 104 is positioned on the housing 106 such that the fork bolt 104 is aligned with the at least one cam surface 112. When the hood 52 is positioned adjacent the vehicle body 14, the striker 115 travels through the striker channel 114 into and a portion of the fork bolt 104 to place the fork bolt 104 in the latched position as shown in FIG. 2B. As the folk bolt 104 is rotated into the fully latched position, the distal end 226 of the first arm 222 of the second lever 218 rides against the external cam surface 158 of the fork bolt 104 causing the second lever 218 to rotate counterclockwise, as shown in FIG. 7B, such that the projection 230 clears the abutment surface 125 of the latch member 102, as shown in 7A.

Additionally as the folk bolt 104 is rotated into the fully latched position, the engagement surface 157 of the fork bolt 104 acts on the distal end 220 of the first lever 216 causing the first lever 216 to rotate in a counter clock-wise, as shown in FIG. 7B, independent of the motion of the mounting plate 202. This can be seen by the second distal end 220 of the first lever 216 separating from the first end 204 of the mounting plate 202. The independent rotation of the first lever 216 with respect to the mounting plate 202 enables the return of the latch member 102 to the fully latched position without causing the second lever 218 to move in a translational direction, thus avoiding the projection 230 from impacting the abutment surface 125.

The detailed description and the drawings or figures are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment may be combined with one or a plurality of other desired characteristics from other embodiments, resulting in other embodiments not described in words or by reference to the drawings. Accordingly, such other embodiments fall within the framework of the scope of the appended claims.

We claim:

1. A vehicle comprising:

a vehicle body defining a compartment;

a hood panel adjustably mounted to the vehicle body and configured to selectively cover and uncover the compartment, the hood panel includes a striker; and a latching mechanism configured to selectively engage and release the striker, the latching mechanism includes:

a housing secured to the vehicle body, wherein the housing includes a first side, an opposing second side;

a latch member pivotally connected to the first side of the housing, the latch member includes an external side surface defining an abutment surface;

a fork bolt pivotally connected to the opposing second side of the housing, the fork bolt includes an engagement surface; and an actuator assembly pivotally connected to the opposing second side of the housing, the actuator assembly includes a first lever configured to selectively abut against the engagement surface of the fork bolt and a second lever configured to selectively engage the abutment surface of the latch member; and wherein the actuator assembly includes an elongated mounting plate pivotally connected to the housing, the elongated mounting plate includes a first end and a second end opposite the first end; and wherein the first lever is pivotally connected proximal to the first end of the elongated mounting plate and the second lever is pivotally connected proximal to the second end of the elongated mounting plate.

2. The vehicle of claim 1, wherein the elongated mounting plate and the first lever are co-axially pivotally connected to the housing.

3. The vehicle of claim 1, wherein the first lever and the second lever are pivotally connected to the elongated mounting plate between the elongated mounting plate and the housing.

4. The vehicle of claim 2, wherein the elongated mounting plate includes a side surface defining a stop tab configured to cooperate with an abutment surface defined on the housing to limit a pivotal rotation of the elongated mounting plate with respect to the housing.

5. The vehicle of claim 1, wherein the fork bolt includes an external cam surface, wherein the second lever includes a first arm and a second arm defining a substantially C-shaped profile, and wherein the first arm includes a distal end configured to ride against the external cam surface of the fork bolt.

6. The vehicle of claim 5, wherein the second arm includes a distal end having a projection configured to engage the abutment surface defined on the latch member.

7. The vehicle of claim 6, wherein the latching mechanism includes a biasing member having a first end attached to the housing and a second end attached to the second arm of the second lever such that the biasing member rotatably biases the elongated mounting plate in a first direction.

8. The vehicle of claim 7, wherein the second lever is adapted to cooperate with the elongated mounting plate such that the projection on the second arm of the second lever selectively moves in translational direction clearing the abutment surface of the latch member.

9. The vehicle of claim 8, wherein the biasing member is a coiled spring under tension.

10. A latching mechanism for releasably engaging a striker of a hood panel to a vehicle body comprising:

a housing securable to the vehicle body, the housing includes a first side, an opposing second side, and at least one housing cam surface;

a latch member pivotally connected to the first side of the housing, the latch member includes an external surface defining an abutment surface;

a fork bolt adjustably connected to the opposing second side of the housing and movable between a fully latched position, wherein the fork bolt secures the striker to fasten the hood panel to the vehicle body, and a first actuated position, wherein the striker is released from the fork bolt, and wherein the fork bolt includes an external cam surface and an engagement surface; and an actuator assembly pivotally connected to the opposing second side of the housing, the actuator assembly includes a first lever configured to selectively abut against the engagement surface of the fork bolt and a second lever configured to selectively engage the external cam surface of the fork bolt; and wherein the actuator assembly includes a pivotal elongated mounting plate having a first end, an opposite second end, and a side surface, wherein the first lever and the second lever are pivotally connected to the elongated mounting plate between the elongated mounting plate and the housing.

11. The latching mechanism of claim 10, wherein the first lever is pivotally connected on the elongated mounting plate proximal to the first end and the second lever is pivotally connected on the elongated mounting plate proximal to the second end.

12. The latching mechanism of claim 11, wherein the first lever includes a first distal end configured to selectively abut against the engagement surface of the fork bolt to retain the fork bolt in the fully latched position.

13. The latching mechanism of claim 11, wherein the second lever includes a first arm and a second arm cooperating with the first arm defining a substantially C-shaped profile.

14. The latching mechanism of claim 13, wherein the first arm includes a distal end configured to ride against the external cam surface of the fork bolt.

15. The latching mechanism of claim 14, wherein the second arm includes a distal end having a projection configured to engage the abutment surface defined on the latch member.

16. The latching mechanism of claim 15, wherein the latching mechanism includes a spring having a first end attached to the housing and a second end attached to the second arm of the second lever such that the spring rotatably biases the elongated mounting plate in a first direction.

* * * * *